US011585592B2

(12) United States Patent
Burke et al.

(10) Patent No.: US 11,585,592 B2
(45) **Date of Patent: *Feb. 21, 2023**

(54) WALL PANEL FOR AN APPLIANCE

(71) Applicant: WHIRLPOOL CORPORATION, Benton Harbor, MI (US)

(72) Inventors: Julia B. Burke, Chicago, IL (US); Daniel Chow, St. Joseph, MI (US); Daniel V. Clements, St. Joseph, MI (US); Rebecca M. Goesling, Chicago, IL (US); Mark W. Schulz, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/679,538

(22) Filed: Feb. 24, 2022

(65) Prior Publication Data

US 2022/0178607 A1 Jun. 9, 2022

Related U.S. Application Data

(63) Continuation of application No. 16/766,169, filed as application No. PCT/US2017/067025 on Dec. 18, 2017, now Pat. No. 11,274,874.

(51) Int. Cl.

| | |
|---|---|
| ***F25D 23/06*** | (2006.01) |
| ***F25D 27/00*** | (2006.01) |
| ***F25D 23/02*** | (2006.01) |

(52) U.S. Cl.
CPC ..... *F25D 23/066* (2013.01); *F25D 23/028* (2013.01); *F25D 27/005* (2013.01); *F25D 2323/021* (2013.01); *F25D 2323/06* (2013.01); *F25D 2400/18* (2013.01)

(58) Field of Classification Search
CPC .... F25D 23/066; F25D 23/065; F25D 23/028; F25D 2323/06; F25D 2323/02; F25D 27/005; F25D 2400/18
See application file for complete search history.

(56) References Cited

U.S. PATENT DOCUMENTS

| | | | |
|---|---|---|---|
| 2,628,877 | A | 2/1953 | Woo |
| 4,694,553 | A | 9/1987 | Tate, Jr. et al. |
| 5,180,222 | A | 1/1993 | Robinson |

(Continued)

FOREIGN PATENT DOCUMENTS

| | | | |
|---|---|---|---|
| CN | 102037300 | A | 4/2011 |
| CN | 203043026 | U | 7/2013 |

(Continued)

*Primary Examiner* — Daniel J Rohrhoff
(74) *Attorney, Agent, or Firm* — Price Heneveld LLP

(57) ABSTRACT

A refrigerator includes a cabinet with a plurality of walls and a compartment area for storing food within the cabinet. A door is configured to seal the compartment area. A refrigeration component is disposed within the cabinet. A wall panel is positioned within the cabinet and includes a three-dimensional molded surface with non-uniformly spaced peaks and valleys and a lighting structure. The wall panel extends from a lower end of the compartment area to an upper end of the compartment area. The wall panel separates the compartment area from the refrigeration component and is coextensive with one of the plurality of walls of the cabinet.

19 Claims, 10 Drawing Sheets

(56) References Cited

U.S. PATENT DOCUMENTS

| | | | | |
|---|---|---|---|---|
| 5,374,118 | A | 12/1994 | Kruck et al. | |
| 6,138,432 | A | 10/2000 | Banicevic | |
| 6,240,739 | B1 * | 6/2001 | Hayes | A47F 3/0482 454/193 |
| 11,079,171 | B2 * | 8/2021 | Marinello | F25D 23/066 |
| 11,274,874 | B2 * | 3/2022 | Burke | F25D 23/028 |
| 2006/0096303 | A1 | 5/2006 | Kavounas | |
| 2007/0227179 | A1 * | 10/2007 | Yoo | F25D 23/066 62/298 |
| 2007/0250391 | A1 | 10/2007 | Prade et al. | |
| 2007/0266723 | A1 | 11/2007 | Lee et al. | |
| 2008/0245788 | A1 | 10/2008 | Choong et al. | |
| 2008/0271478 | A1 * | 11/2008 | Pinto | F25B 39/024 62/515 |
| 2010/0170289 | A1 | 7/2010 | Graziano | |
| 2011/0162403 | A1 | 7/2011 | Selin et al. | |
| 2012/0085116 | A1 | 4/2012 | Maeng et al. | |
| 2012/0103006 | A1 | 5/2012 | Jung et al. | |
| 2015/0241117 | A1 | 8/2015 | Burke et al. | |
| 2015/0379905 | A1 | 12/2015 | Kawasaki-Hedges et al. | |
| 2016/0123655 | A1 | 5/2016 | Chow et al. | |
| 2016/0281959 | A1 * | 9/2016 | Khizar | A47L 15/4246 |
| 2016/0313053 | A1 | 10/2016 | Eicher et al. | |
| 2018/0127150 | A1 | 5/2018 | Adanur et al. | |
| 2019/0137166 | A1 * | 5/2019 | Dherde | F25D 23/062 |
| 2020/0206373 | A1 | 7/2020 | Winslow et al. | |
| 2021/0247125 | A1 * | 8/2021 | Marinello | F25D 17/06 |

FOREIGN PATENT DOCUMENTS

| | | | |
|---|---|---|---|
| CN | 204329437 | U | 5/2015 |
| CN | 204555542 | U | 8/2015 |
| CN | 104930410 | A | 9/2015 |
| CN | 105042980 | A | 11/2015 |
| CN | 105814383 | A | 7/2016 |
| EP | 1840489 | A2 | 10/2007 |
| JP | H04143584 | A | 5/1992 |
| JP | H10132452 | A | 5/1998 |
| JP | 2000337748 | A | 12/2000 |
| JP | 2004061084 | A | 2/2004 |
| JP | 2004232888 | A | 8/2004 |
| JP | 2011117727 | A | 6/2011 |
| WO | 2007117501 | A2 | 10/2007 |
| WO | 2013004685 | A2 | 1/2013 |
| WO | 2017098694 | A1 | 6/2017 |

* cited by examiner

WALL PANEL FOR AN APPLIANCE

CROSS-REFERENCE TO RELATED APPLICATIONS

This application is continuation of U.S. application Ser. No. 16/766,169, filed on May 21, 2020, now U.S. Pat. No. 11,274,874, entitled "WALL PANEL FOR AN APPLIANCE," which is a National Stage Application under 35 U.S.C. § 371 of International Application No. PCT/US2017/067025, filed on Dec. 18, 2017, entitled "WALL PANEL FOR AN APPLIANCE," the entire disclosure of which is hereby incorporated herein by reference.

BACKGROUND OF THE DISCLOSURE

The present disclosure generally relates to wall panels for an appliance.

SUMMARY OF THE INVENTION

According to one aspect of the present disclosure, a refrigerator includes a cabinet with a plurality of walls and a compartment area for storing food within the cabinet. A door is configured to seal the compartment area. A refrigeration component is disposed within the cabinet. A wall panel is positioned within the cabinet and includes a three-dimensional molded surface with non-uniformly spaced peaks and valleys and a lighting structure. The wall panel extends from a lower end of the compartment area to an upper end of the compartment area. The wall panel separates the compartment area from the refrigeration component and is coextensive with one of the plurality of walls of the cabinet.

According to another aspect of the present disclosure, an appliance includes a cabinet that has a back wall, a top wall, a bottom wall, and a pair of side walls and a compartment area for storing food within the cabinet. A door is configured to seal the compartment area. A storage structure is disposed within the compartment area. The appliance also includes a wall panel. The wall panel is co-extensive with the back wall of the cabinet and extends a full height and width of the back wall of the cabinet. The wall panel includes a three-dimensional molded surface.

According to yet another aspect of the present disclosure, an appliance includes a cabinet that defines a compartment area for storing food within the cabinet. A door is operably coupled with the cabinet. A wall panel is disposed within the cabinet. The wall panel is co-extensive with a back wall of the cabinet and extends a full height and width of the back wall of the cabinet. The wall panel includes a three-dimensional molded surface with irregular alternating peaks and valleys that extend from a first side end of the wall panel to a second side end of the wall panel.

These and other features, advantages, and objects of the present disclosure will be further understood and appreciated by those skilled in the art by reference to the following specification, claims, and appended drawings.

BRIEF DESCRIPTION OF THE DRAWINGS

Further advantages and features according to the present disclosure will become clear from the following detailed description provided as a non-limiting example, with reference to the attached drawings in which.

Figure 1:
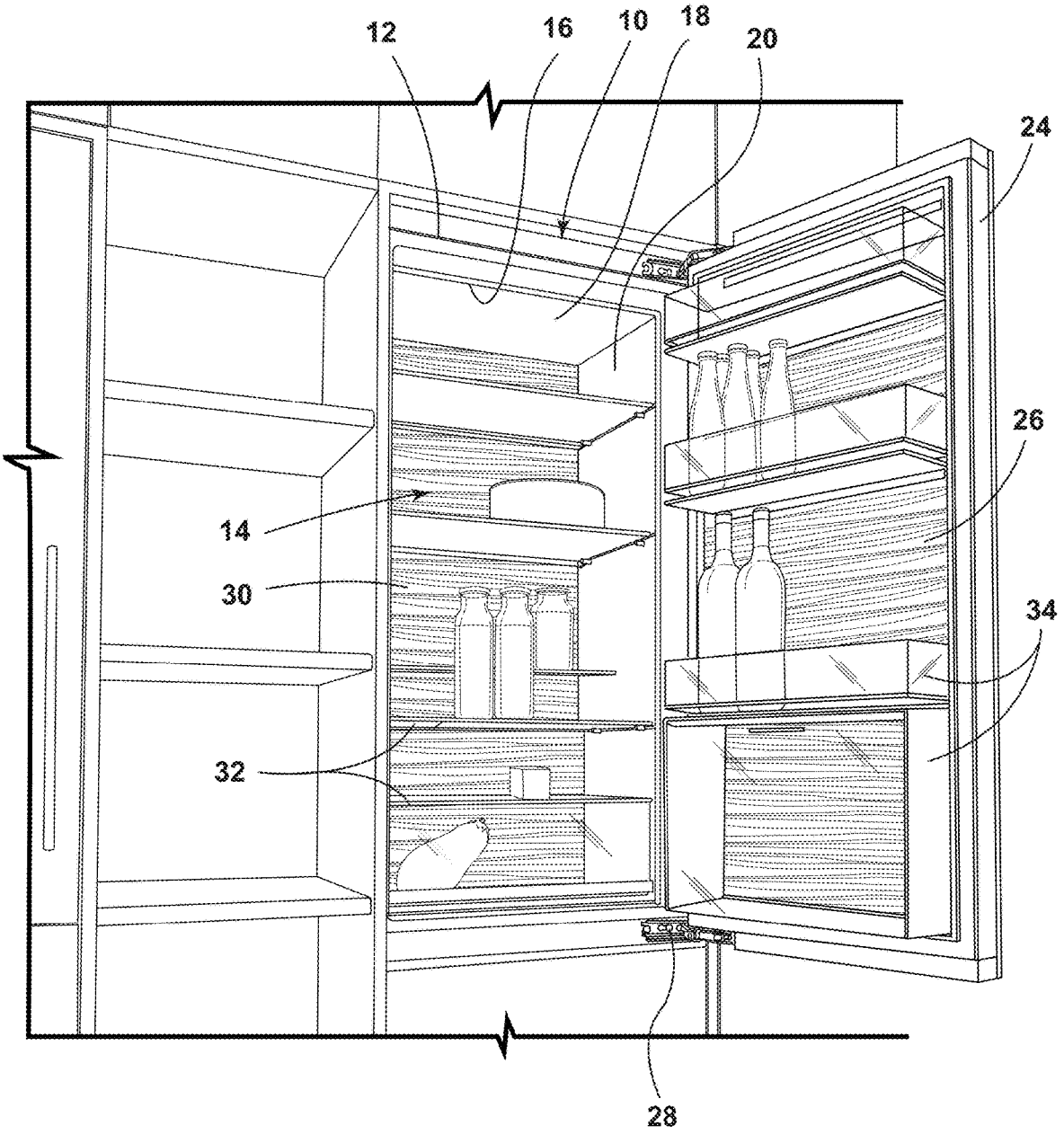
FIG. 1 is a side perspective view of a refrigerator incorporating a wall panel, according to an embodiment of the present disclosure.

The components in the figures are not necessarily to scale, emphasis instead being placed upon illustrating the principles described herein.

DETAILED DESCRIPTION

The present disclosure provides a wall panel for an appliance, such as for refrigerator 10 shown in an illustrated embodiment. The disclosure also provides various structures and components related to a wall panel. According to aspects described herein, the wall panel may be configured as a false wall that extends a full height and width of a wall of a compartment within the appliance. As described in more detail below with respect to FIGS. 1-11, according to various embodiments, the wall panel may serve as a "false wall" within a refrigerator compartment and cover or obscure one or more refrigeration components that may be contained within, or visible within, the refrigerator cabinet. In addition, the wall panel may be configured as an aesthetic piece, such as a colored panel or a panel having a three-dimensional molded pattern, to distinguish the wall panel from other surfaces or interior walls of the refrigerator. The wall panel may be configured to provide both a streamlined aesthetic appearance and also provide better depth perception within the refrigerator compartment for a user. In some embodiments, the wall panel may be configured as a lighted wall panel that moves from a dimly lit state to a fully lit state, or vice versa, based on a user's interaction with the refrigerator, such as when opening a door.

Accordingly, the present illustrated embodiments reside primarily in combinations of apparatus components and method steps related to a wall panel for an appliance, such as refrigerator 10. The apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. In addition, like numerals in the description and drawings represent like elements. It should be further understood, however, that while a refrigerator has been described for purposes of illustration, aspects of the present disclosure apply to any type and style of appliance contemplated in the art, including but not limited to, freezers, beverage storage compartments, ovens, and microwaves.

FIG. 1 depicts an exemplary refrigerator 10, according to an illustrated embodiment set forth herein. Refrigerator 10 includes an outer frame or cabinet 12 that defines or incorporates one or more internal cavities or compartments 14 for cooling food items. Cabinet 12 includes an interior surface 16 and an exterior surface (not shown). Interior surface 16 includes a top wall or top surface 18, a pair of side walls, side surfaces 20, a bottom surface 21 (FIG. 2B) and a back wall or back surface 22. Interior compartment 14 may further incorporate one or more compartment storage structures 32 for storing food items. Compartment storage structures 32 may be configured in a variety of ways, and in some cases may include, but are not limited to, shelves, drawers, and the like, for holding food items. In the illustrated embodiment, refrigerator 10 is a built-in style refrigerator, streamlined to appear as a portion of surrounding cabinetry, however the present disclosure is not limited to a specific style of refrigerator or appliance.

Refrigerator 10 may also incorporate one or more doors 24 for accessing the one or more compartments 14. Door 24 may be operably coupled to cabinet 12 via a hinge assembly 28 to alternately seal and provide access to compartment 14. Door 24 may also incorporate one or more storage structures 34 for holding food items. Door 24 storage structures 34 may also take many forms, including shelves, drawers, or other compartments for holding food items.

Figure 2A:
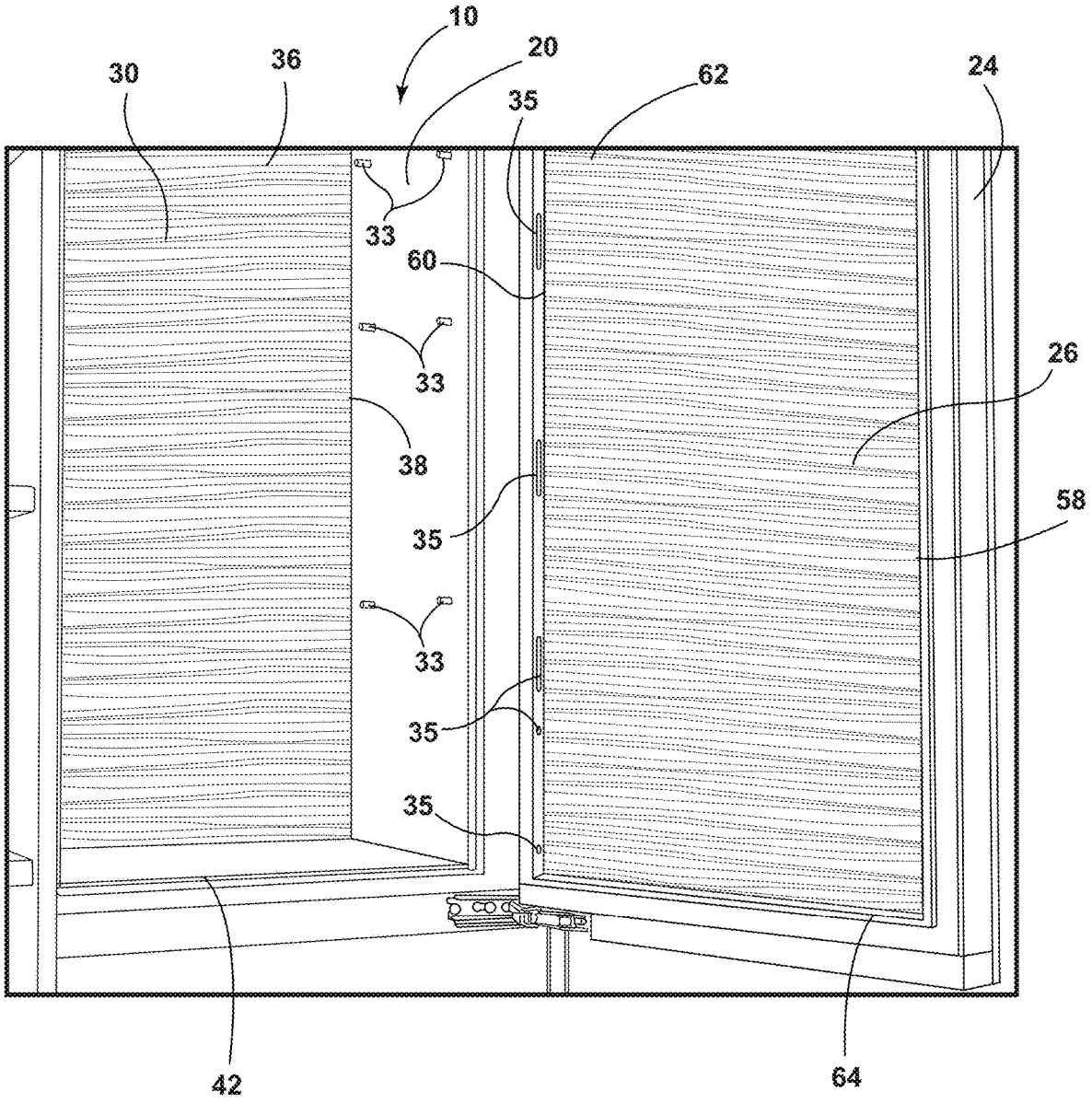
FIG. 2A is a partial side perspective view of the refrigerator incorporating a wall panel, with various components removed, according to an embodiment of the present disclosure.
Figure 2B:
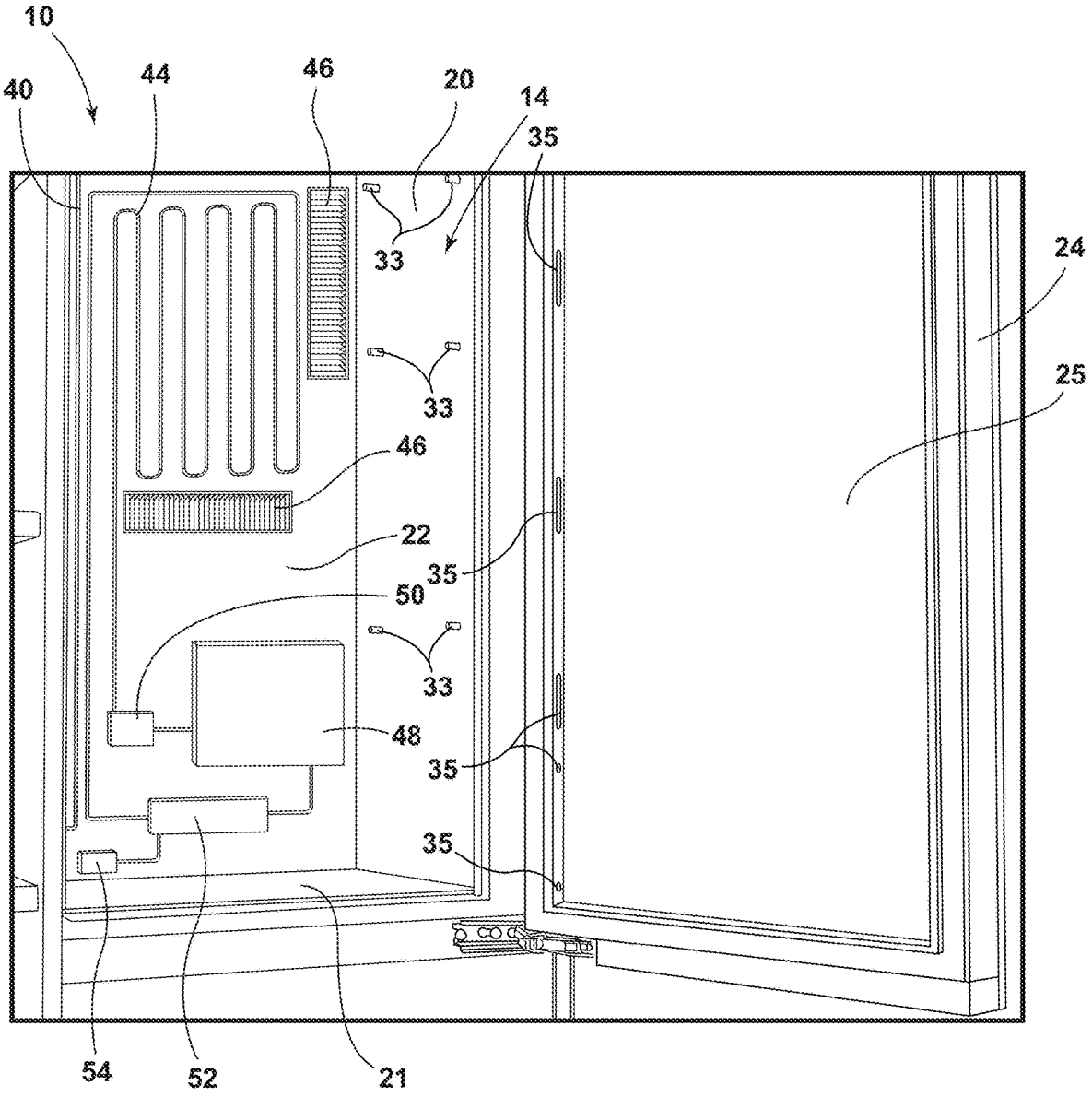
FIG. 2B is a partial side perspective view of the refrigerator, with the wall panel and various components removed, according to an embodiment of the present disclosure.
Figure 3:
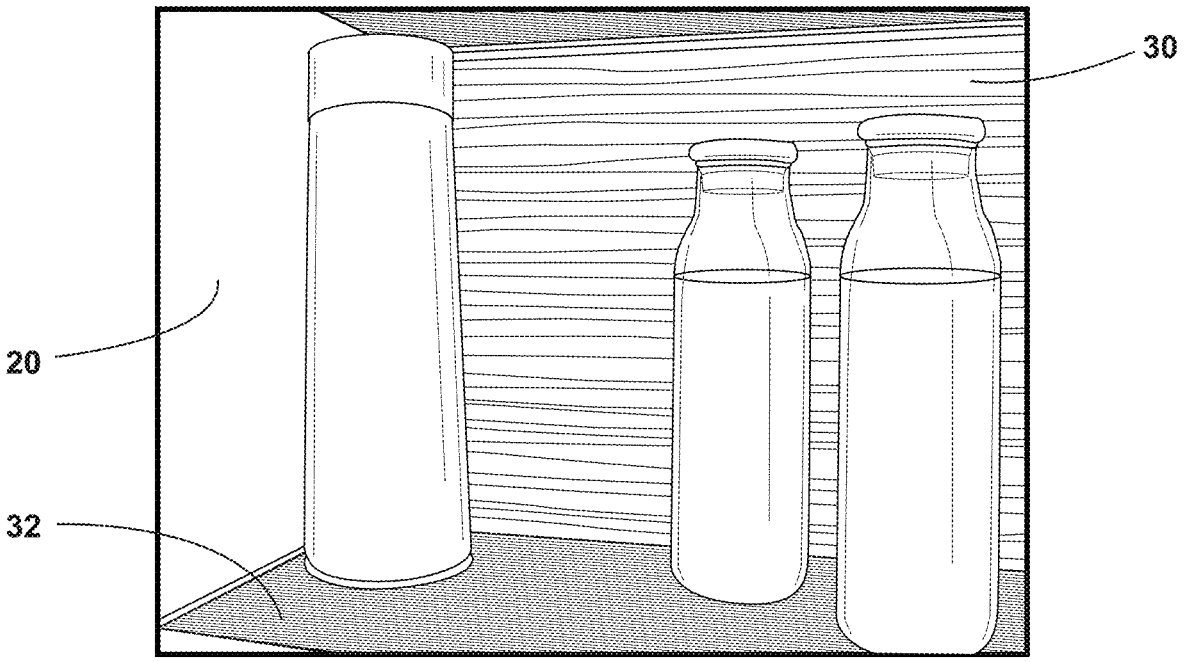
FIG. 3 is another partial view of a portion of a wall panel in a refrigerator, according to an embodiment of the present disclosure.

In at least one embodiment, refrigerator 10 may further include one or more wall panels within cabinet 12 to provide a seamless backdrop and disguise one or more of refrigerator components, such as refrigerator components shown and described with respect to FIG. 2B. For example, as discussed in more detail below, refrigerator 10 may incorporate one or more interior wall panels, such as wall panel 30. Refrigerator 10 may also incorporate one or more door panels, such as door skin or panel 26.

FIG. 2A depicts an enlarged perspective view of a portion of refrigerator 10.

FIG. 2B depicts a similar view as FIG. 2A, with a wall panel 30, and both compartment storage structures 32 and door storage structures 34 removed, for illustration. As depicted in FIG. 2B, refrigerator 10 may include one or more refrigerator components that may serve to provide cool air to compartment 14. In particular, refrigerator 10 may include evaporator coils 44 for removing heat from compartment 14, compressor 52, and condenser coils 48 for dissipating heat outside of refrigerator 10, air vents 46 for moving air within compartment 14, expansion valve 50, water lines 56, and control circuitry 54. Control circuitry 54 may be configured to control the refrigerator components as well as various other electrical or mechanical refrigerator components of refrigerator 10, such as lights or alarms. Furthermore, while the various refrigerator components depicted in FIG. 2B may be depicted as being disposed within, or partially within, compartment 14, one or more of the components may reside on an external surface of cabinet 12. For example, condenser coils 48 may be disposed externally to cabinet 12 to dissipate heat.

It should be noted that refrigerator 10 and its various components are shown for purposes of example and illustration, and are not limiting features of the present disclosure. Those skilled in the art will understand that aspects of the present disclosure apply to other types of refrigerators or refrigerator configurations, such as a French-door style refrigerator, side-by-side refrigerator, or any other type of configuration contemplated in the art. Additionally, refrigerator 10 may include more or fewer components, such as additional water lines, temperature control devices or the like, additional storage structures, including shelves, drawers, doors, or other types of refrigerator compartment storage. Accordingly, it should be understood that refrigerator 10 and its described refrigerator components are only exemplary of the types of components that may be included in a refrigerator, and the absence or addition of other structures or refrigerator components does not affect the spirit and scope of the present disclosure. Those skilled in the art will readily recognize the many configurations of components and structures that may be employed in a refrigerator 10, and that aspects of the present disclosure is not limited to the embodiments described herein or as depicted in the figures.

As previously noted, refrigerator 10 may include one or more substantially planar wall panels, such as wall panel 30. In some cases, the wall panels may serve as false walls that are co-extensive with an interior surface of cabinet 12, i.e. extending along the entirety of the interior surface, such as back surface 22 or door 24. In some cases, the wall panels may hide or obscure refrigerator components which would otherwise be visible within compartment 14. The wall panels may also create an aesthetic "wallpaper feel" within compartment 14, and provide better depth perception, allowing food items to stand out more readily to the user.

FIG. 2A depicts refrigerator 10 with both compartment storage structures 32 and door storage structures 34 removed for illustration. According to an illustrated embodiment, refrigerator 10 includes a wall panel 30 that covers back surface 22 and provides a false back wall to compartment 14. Wall panel 30 may be co-extensive with back surface 22 such that it extends the full height and width of back surface 22. Wall panel 30 may extend from bottom surface 21 to top surface 18 of cabinet 12, as well as between pair of side surfaces 20. In other words, wall panel 30 may include a lower end 42 that is proximate bottom surface 21, an upper end 36 that is proximate top surface 18, a right side end 38 that is proximate a right side surface 20, and a left side end 40 (FIG. 4A) that is proximate opposite left side surface 20. Accordingly, wall panel 30, as fully depicted in FIG. 2A, may create an entire back false wall of compartment 14. Additionally, one or more wall panels similar to wall panel 30 may be positioned against any of side surfaces 20, top surface 18, or bottom surface 21 in a similar manner as wall panel 30, to create one or more false walls for the side, top, or bottom surfaces, respectively, of compartment 14.

Referring to FIGS. 1 and 2A, wall panel 30 may be configured to extend behind, and independently of, one or more compartment storage structures 32, allowing for ease of replacement and further contributing to a clean and streamlined appearance within compartment 14. Specifically, in some cases, compartment storage structures 32 may be secured independently of wall panel 30, such as within compartment 14 via compartment mounting structures 33, or by other means as would be contemplated by a skilled artisan.

Figure 5:
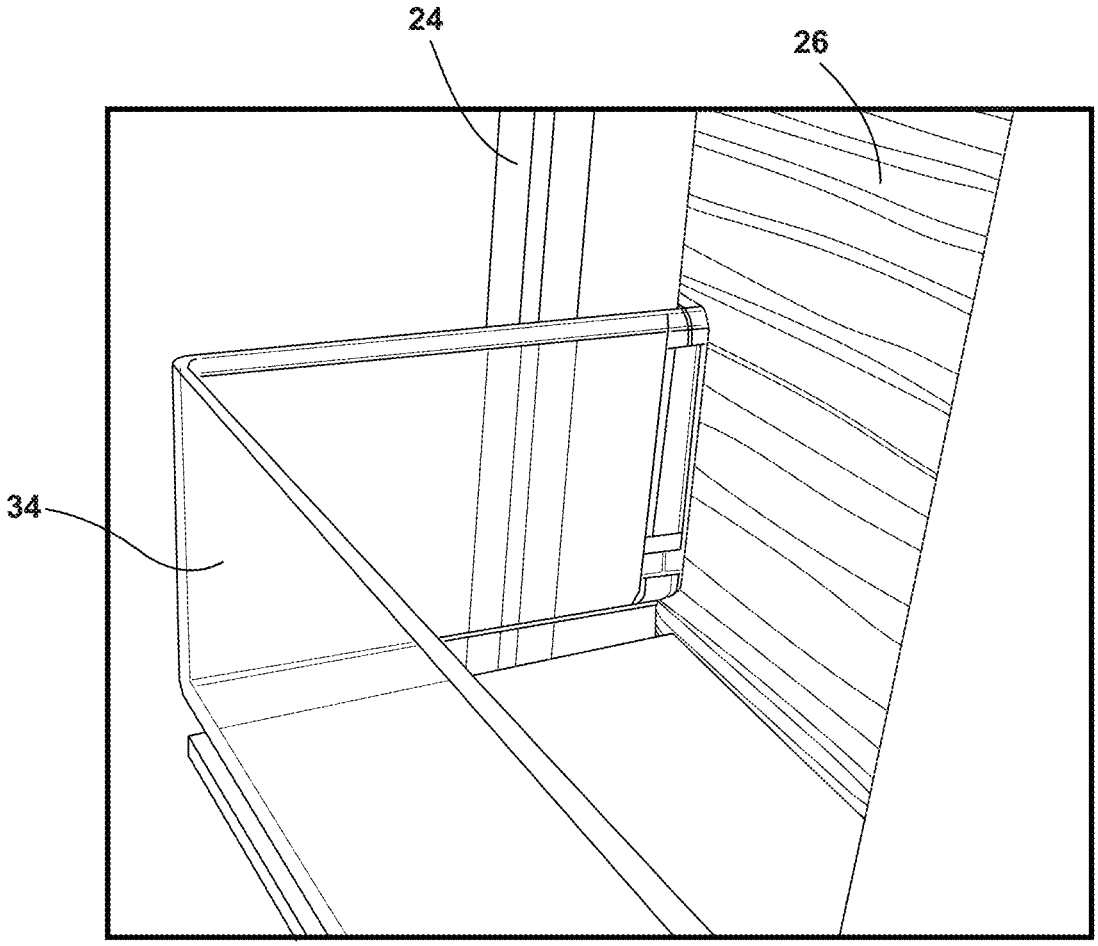
FIG. 5 is a partial side perspective view of a portion of wall panel on a door of a refrigerator, according to an embodiment of the present disclosure.

In some embodiments, refrigerator 10 may also include a panel that serves as a false wall on an interior surface of door 24, similar to wall panel 30. FIGS. 1, 2A, and 5 depict a door panel 26 which may be co-extensive with an interior surface 25 of door 24. In at least one embodiment, door panel 26 may include a door panel upper edge 62, a door panel lower edge 64, a door panel right side edge 58, and a door panel left side edge 60, each of which are proximate to respective side edges of interior surface 25 of door 24. Accordingly, door panel 26, as fully depicted in FIG. 2A, may extend the entire height and width of door 24, creating a false wall for door 24. Similar to wall panel 30, door panel 26 may also be configured to extend behind, and be installed independently of, one or more door storage structures 34. Similar to wall panel 30, the independent configuration and installment allows for ease of replacement and contributes to a clean and streamlined appearance on the interior of door 24. Accordingly, in some cases, door storage structures 34 may be secured on an interior surface of door 24 via one or more mounting structures 35, or by any other methods contemplated by a skilled artisan, such as by welding, adhesive or other known methods.

As noted above, in some embodiments, wall panels may be configured to provide both functional and aesthetic elements for refrigerator 10. For example, in some cases wall panels may hide or disguise one or more refrigerator components or structures disposed behind the panel, such as the refrigerator components depicted in FIG. 2B. Referring to the illustrated embodiment, wall panel 30 may hide one or more refrigerator components that are disposed within cabinet 12, or are visible from an interior surface 16, creating a clean aesthetic look and feel within compartment 14. Accordingly, referring to FIG. 2B as viewed with wall panel 30 removed for purposes of illustration, it may be seen that wall panel 30 may provide a false back wall for compartment 14 serving to hide one or more refrigerator components that would be otherwise visible to a user within compartment 14. Similarly, door panel 26, may serve to hide one or more refrigerator components located on, or visible from an interior surface 25 of door 24.

According to aspects of the disclosure, wall panel 30 and door panel 26 may include a design or other pattern that provides a wallpaper-like feel within compartment 14. In some cases, a wall panel may include a contrasting color, a contrasting sheen such as a mirrored or highly reflective surface, a pattern, a lighted surface, or a three-dimensional molded design. Incorporating such a surface may provide a streamlined look, and in some cases give an apparent structure to the surface, creating better depth perception within compartment 14. In addition, the design or pattern may help to distinguish wall panel 30 and door panel 26 from the other walls of the refrigerator.

Figure 4A:
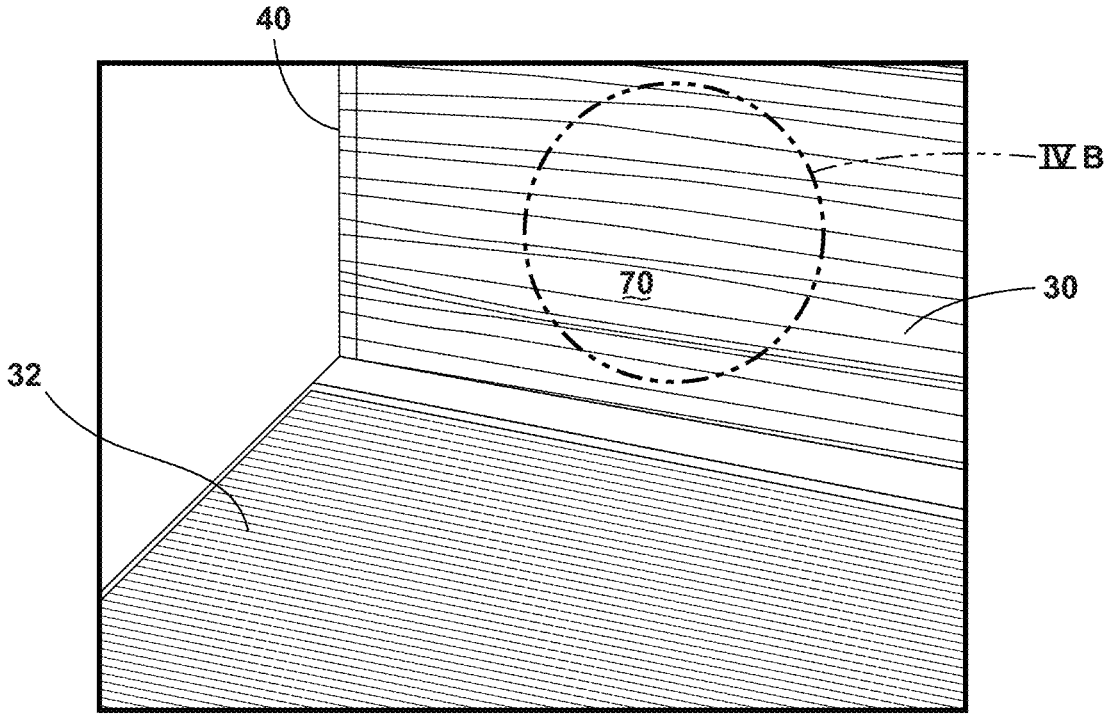
FIG. 4A is yet another partial view of a portion of a wall panel in a refrigerator, according to an embodiment of the present disclosure.
Figure 4B:
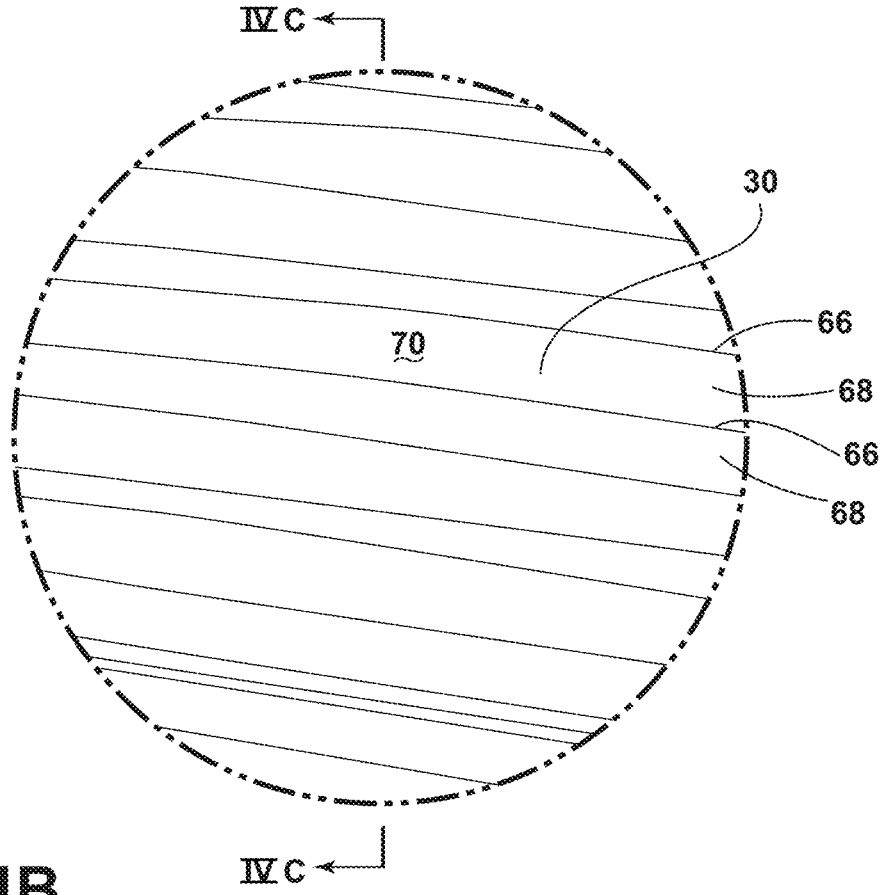
FIG. 4B is an exploded view of area IV B in FIG. 4A.
Figure 4C:
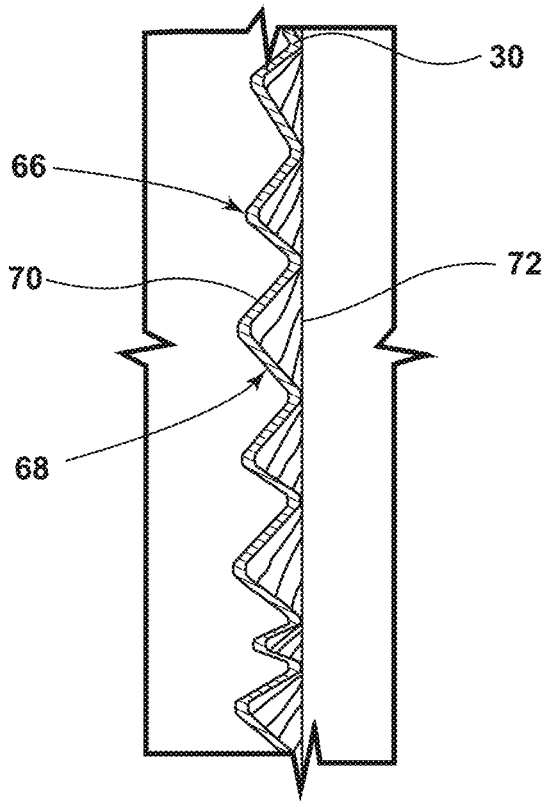
FIG. 4C is a cross-sectional view taken across line IV C in FIG. 4B.

In at least one embodiment, a wall panel 30 may include a three-dimensional molded wave pattern, such as shown more specifically in the illustrated embodiment of FIGS. 3 and 4A-4C. For example, referring to FIGS. 4B and 4C, wall panel 30 may include a molded three-dimensional wave pattern. As best seen in the cross-sectional view of FIG. 4C, taken across line IV C in FIG. 4B, wall panel 30 includes a compartment facing side 70 and a cabinet facing side 72. Compartment facing side 70 may exhibit a pattern peak 66, jutting outward from cabinet facing side 72, and pattern valley 68. In some cases, cabinet facing side 72 may include a flat surface, as shown in FIG. 4C. However, in other cases, cabinet facing side 72 may include a three-dimensional molded surface similar to the molded surface of compartment facing side 70. In still other cases, cabinet facing side 72 may include a three-dimensional molded surface to align or match with one or more refrigeration components disposed beneath. Of course, it will be understood that the molded three-dimensional wave pattern of the illustrated embodiment is only one embodiment of many contemplated herein, and the present disclosure is not limited to the specific patterns shown or described herein.

Figure 6:
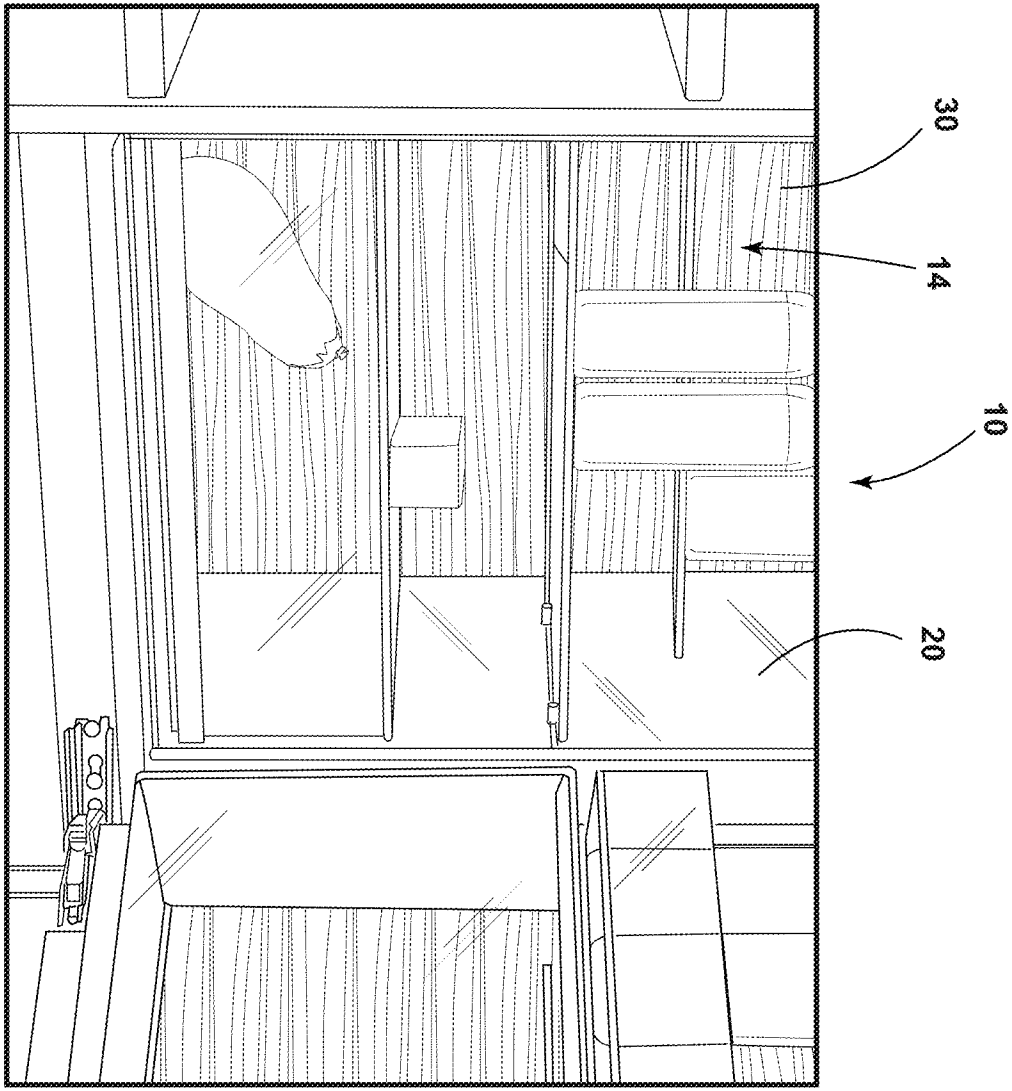
FIG. 6 is another partial side perspective view of a portion of a wall panel in a refrigerator, according to an embodiment of the present disclosure.

In some embodiments, refrigerator 10 may include further provisions that create an overall appearance of a larger and wider, or brighter, compartment 14. For example, refrigerator 10 may include one or more walls having a highly reflective or mirrored surface. In some cases, surfaces within compartment 14 may incorporate an actual mirror, providing a reflective surface which creates a larger look. In other cases, surfaces within compartment 14 incorporate a high-gloss black or other reflective color. In at least one embodiment, refrigerator 10 includes a reflective mirrored side surface 20 as shown in FIG. 6. The reflective mirrored side surface 20 may reflect light within compartment 14, creating a more even distribution and allowing the consumer to view items that may otherwise be hidden.

Figure 7:
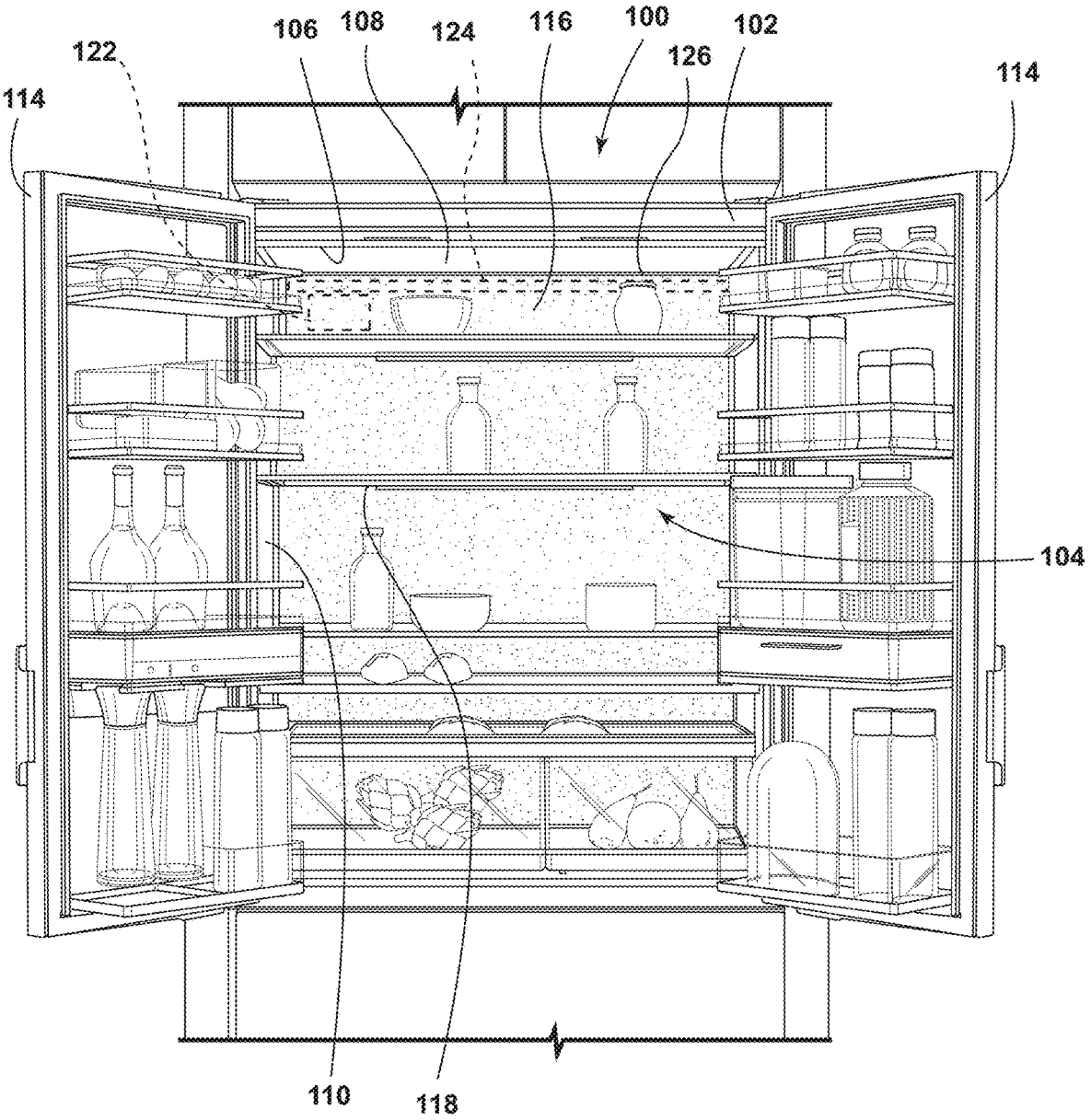
FIG. 7 is a front elevation view of another refrigerator incorporating a wall panel, according to another embodiment of the present disclosure.
Figure 8:
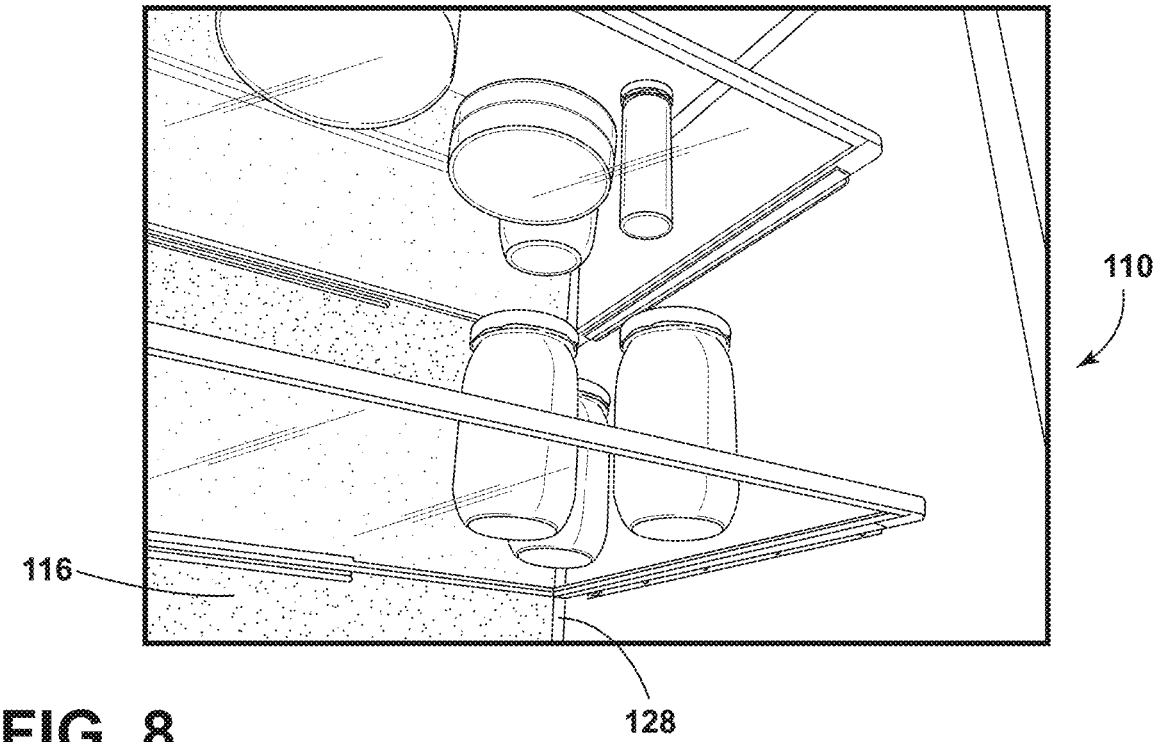
FIG. 8 is a bottom perspective view of a portion of the wall panel in the refrigerator, according to an embodiment of the present disclosure.
Figure 9:
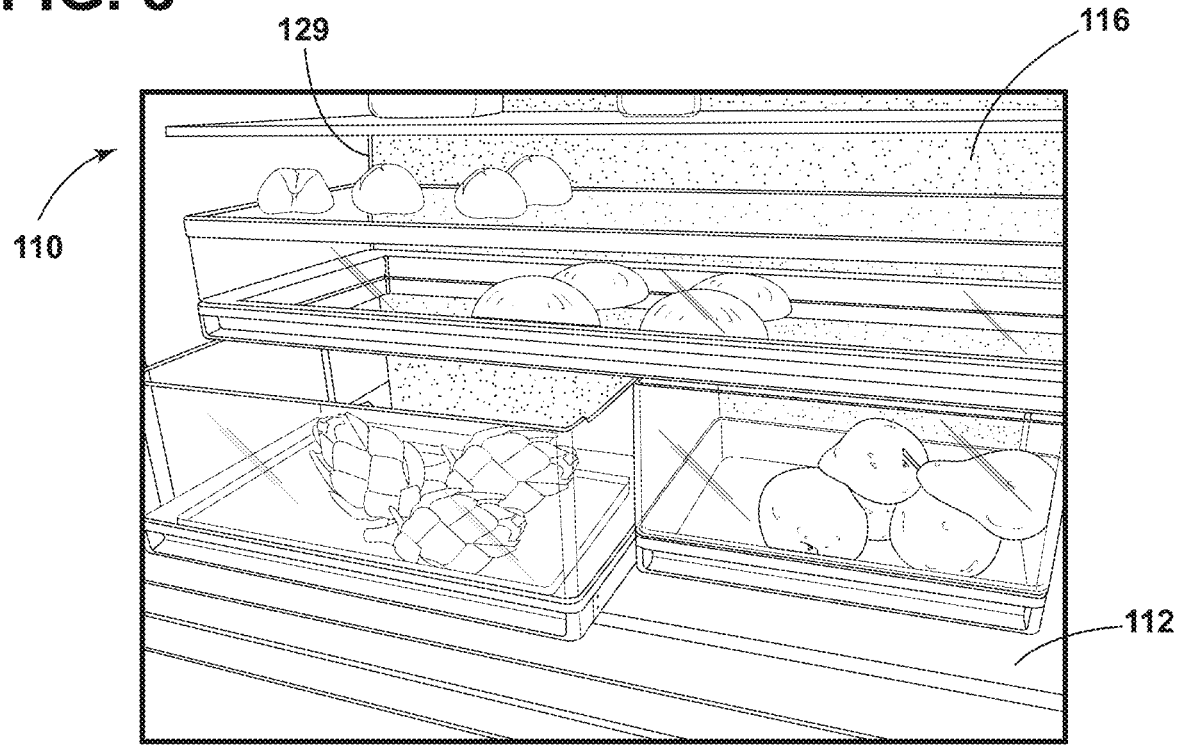
FIG. 9 is another top perspective view of a portion of the wall panel in the refrigerator, according to an embodiment of the present disclosure.

FIGS. 7-9 depict another embodiment of an appliance, refrigerator 100, which incorporates aspects of the present disclosure. Similar to refrigerator 10 in FIG. 1, refrigerator 100 may also include an outer frame or cabinet 102 that defines or incorporates one or more internal cavities or compartments 104 for cooling food items. Cabinet 102 includes an interior surface 106 and an exterior surface (not shown). Interior surface 106 includes a top surface 108, a pair of side surfaces 110, a bottom surface 112 (FIG. 9) and a back surface (not shown). Interior compartment 104 may further incorporate one or more compartment storage structures 118 for storing food items. Compartment storage structures 118 may be configured in a variety of ways, and in some cases may include but are not limited to shelves, drawers, and the like, for holding food items, as depicted. Refrigerator 100 may also incorporate one or more doors 114 for accessing the one or more compartments 104. Doors 114 may be operably coupled to cabinet 102, to alternately seal and provide access to compartment 104. Further, as discussed in more detail below, refrigerator 100 may incorporate one or more wall panels, including but not limited to a lighted wall panel 116 disposed behind compartment storage structures 118.

In at least one embodiment, wall panel 116 provides a false back wall for compartment 104, covering a back surface (not shown) of cabinet 102. Similar to wall panel 30 described above, wall panel 116 may be co-extensive with a back surface of cabinet 102 such that it extends the full height and width of the back surface. Thus, wall panel 116 may extend from bottom surface 112 to top surface 108 of cabinet 102, as well as between pair of side surfaces 110. In other words, wall panel 116 may include a lower end (not shown) that is proximate a bottom surface of cabinet 102, an upper end 126 that is proximate a top surface 108, a right side end 128 that is proximate a right side surface 110 (FIG. 8), and a left side end 129 (FIG. 9) that is proximate an opposite left side surface 110. Accordingly, wall panel 116, as depicted in FIG. 7, may create an entire back false wall of compartment 104. Additionally, in other embodiments, one or more wall panels similar to wall panel 116 may be positioned against any of side surfaces 110, top surface 108 or bottom surface 112 in a similar manner as wall panel 116 to create one or more false walls for the side, top or bottom surfaces 110, 108, 112, respectively, of compartment 104. Similar to previous embodiments, wall panel 116 may also be configured to extend behind, and be installed independently of, one or more compartment storage structures 118, allowing for ease of replacement and contributing to a clean and streamlined appearance within compartment 104.

Wall panel 116 may also be configured to provide both functional and aesthetic elements for refrigerator 100. For example, wall panel 116 may serve to hide or disguise one or more refrigerator components or structures disposed behind the wall panel 116, such as one or more refrigerator components (not shown), similar to embodiments described above. In at least one embodiment, wall panel 116 may also incorporate one or more lights or lighting structures 124 in proximity to wall panel 116 to provide light to compartment 104. For example, referring to FIG. 7, lighting structures 124, such as a light strip, may be provided behind wall panel 116. However, in other embodiments, lighting structures may be disposed in other locations near wall panel 116, or incorporated in a surface of wall panel 116.

Wall panel 116 may be comprised of a glass, plastic, or other material that allows light from lighting structures 124 to illuminate wall panel 116. For example, wall panel 116 may include a semi-opaque glass surface that allows light to shine through, yet prevents a user from seeing through wall panel 116 to a back surface of cabinet 102. In at least one case, wall panel 116 may be comprised of a milky white glass material, giving compartment 104 a larger feel.

Lighting structures 124 may be configured as would be contemplated by a skilled artisan. For example, lighting structures 124 may include an incandescent light source, a Light Emitting Diode (LED) lamp or bulb, an LED strip, a fluorescent light, or other source of light. In at least one embodiment, lighting structures 124 comprise an LED light strip that is coupled with control circuitry 122 for control and provision of light, as described in more detail below.

Figure 10:
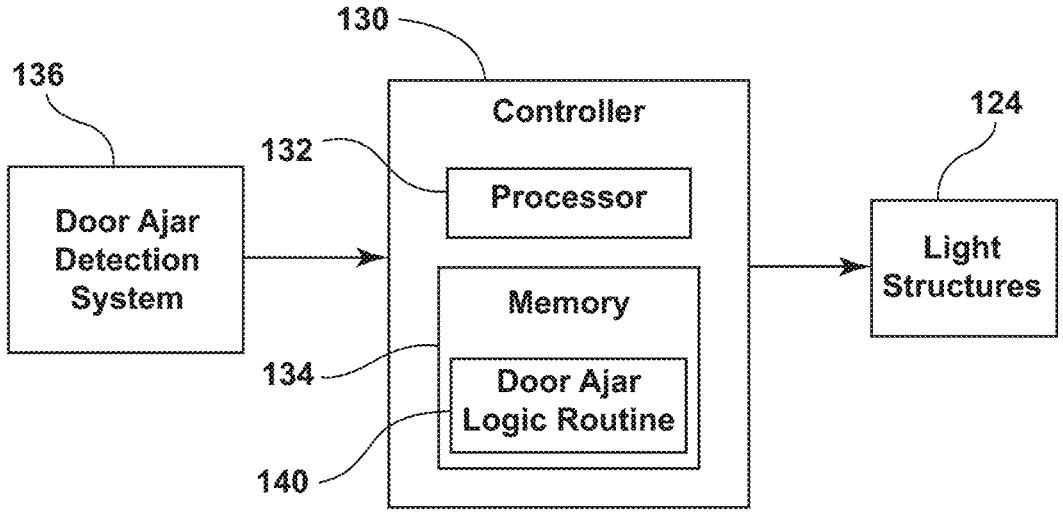
FIG. 10 is a block diagram of control circuitry, according to an embodiment of the present disclosure.

In operation, wall panel 116 may be configured to transition from a dimly lit condition to a fully lit condition when a user opens door 114, or otherwise interacts with refrigerator 100. Thus, in at least some embodiments, refrigerator 100 may include control circuitry 122, including a controller 130 described below, coupled to and configured to communicate with and control various components and systems of refrigerator 100, including lighting structures 124. For example, FIG. 10 depicts exemplary and simplified controller 130 which may be configured to receive inputs from various components of refrigerator 100, such as various sensors and systems, and also to control a variety of components in refrigerator 100, such as cooling components, lights, sounds, and other components as would be known by a skilled artisan. In the illustrated embodiment, for example, a controller 130 may be configured to activate lighting structure 124 associated with lighted wall panel 116.

Controller 130 may be configured as would be understood in the art, and at the very least includes a processor 132 and memory 134. Processor 132 may be configured to run various control algorithms and routines present in memory 134, such as door ajar logic routine 140. However, it will be understood and appreciated that controller 130 may include various other analog or digital circuitries that would be known in the art, and the depiction in FIG. 10 is for illustrative purposes only, and is simplified for understanding of the concepts pertinent to aspects described herein. Furthermore, controller 130 may include many different logic routines for control of various systems within refrigerator 100, including systems for control of lighting structures 124 and wall panel 116, and that door ajar logic routine 140 is only exemplary of one such embodiment of many contemplated herein.

Controller 130 may be coupled to a variety of sensors and systems within refrigerator 100. In at least one embodiment, refrigerator 100 includes at least one door ajar detection system 136, configured to detect when a user opens one or both of doors 114. As noted, however, FIG. 10 is a simplified depiction of a controller 130 which may be associated with refrigerator 100, and it will also be appreciated that refrigerator 100 may include a variety of other known sensors and mechanisms for gathering information for controller 130, or for controlling various aspects of refrigerator 100, including the systems and processes described herein as well as those not discussed herein.

Controller 130 may be configured to receive inputs from the various sensors and systems to make decisions and control aspects or various components of refrigerator 100. In one aspect, controller 130 may receive an indication that a door 114 is in an open position. Such inputs may inform various control routines, such as door ajar logic routine 140, as described in more detail below. The various inputs may also facilitate control of components, such as the actuation and control of lighting structures 124.

Figure 11:
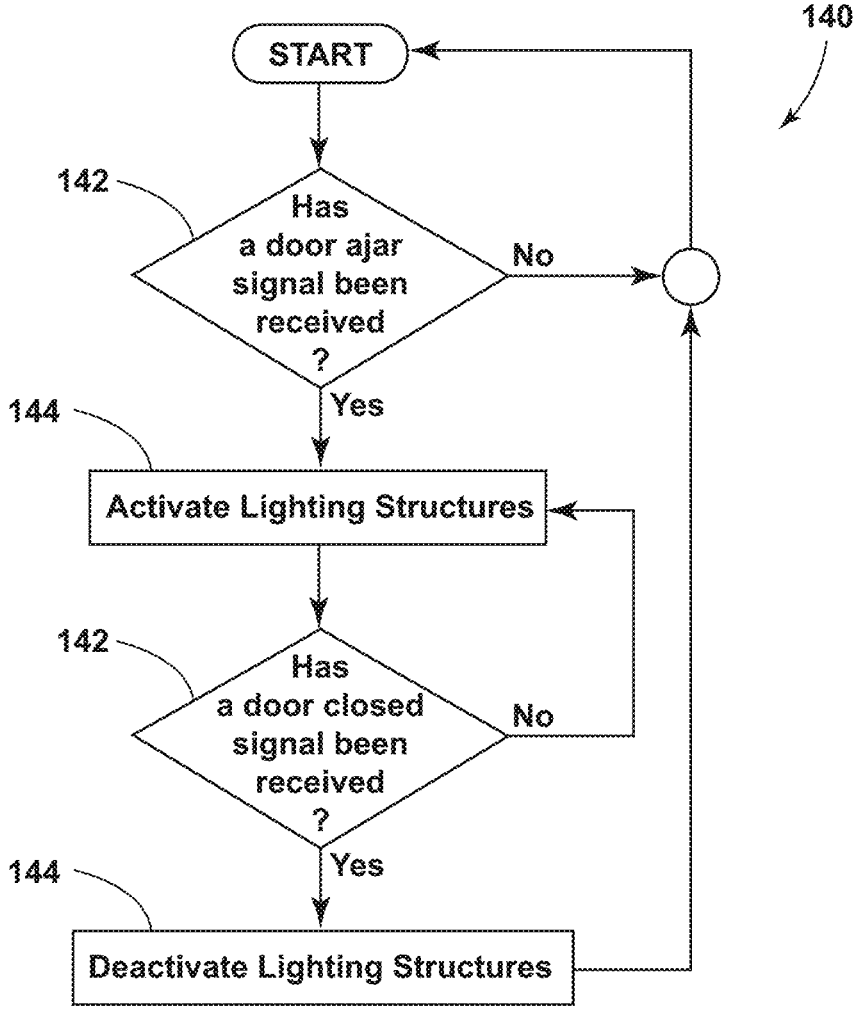
FIG. 11 is a flowchart depicting a wall panel lighting system method, according to an embodiment of the present disclosure.

Referring to FIG. 11, door ajar logic routine 140 may be implemented by controller 130 according to an embodiment described herein. Specifically, at step 142, controller 130 may be configured to receive input from door ajar detection system 136 indicating whether one or both of doors 114 are in an open position. If doors 114 are not open, door ajar logic routine 140 will continue looping. However, if doors 114 are open, at step 144, controller may activate lighting structures 124. At step 146, controller 130 may be configured to receive input from door ajar detection system 136 indicating whether one or both of doors 114 are subsequently closed. If doors 114 have not been closed, door ajar logic routine 140 will continue looping through step 144. However, if doors 114 have been closed, at step 148, controller 130 may deactivate lighting structures 124, and continue to the beginning of door ajar logic routine 140.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of description herein, the terms "upper," "lower," "right," "left," "rear," "front," "vertical," "horizontal," and derivatives thereof shall relate to the disclosure as oriented in FIGS. 1 and 2. Unless stated otherwise, the term "front" shall refer to the surface of the element closer to an intended viewer of the display mirror, and the term "rear" shall refer to the surface of the element further from the intended viewer of the appliance. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A refrigerator comprising:

a cabinet including a plurality of walls;

a compartment area for storing food within the cabinet;

a door configured to seal the compartment area;

a refrigeration component disposed within the cabinet; and a wall panel positioned within the cabinet and comprising a three-dimensional molded surface including non-uniformly spaced peaks and valleys and a lighting structure, wherein:

the wall panel extends from a lower end of the compartment area to an upper end of the compartment area; and the wall panel separates the compartment area from the refrigeration component and is coextensive with one of the plurality of walls of the cabinet.

2. The refrigerator of claim 1, wherein the three-dimensional molded surface extends at least partially into the compartment area.

3. The refrigerator of claim 1, wherein the three-dimensional molded surface comprises a three-dimensional pattern extending from a first side end of the wall panel to a second side end of the wall panel.

4. The refrigerator of claim 1, wherein the lighting structure is positioned to provide light to the compartment area.

5. The refrigerator of claim 1, further comprising:

control circuitry configured to activate the lighting structure based on user interaction with said refrigerator.

6. The refrigerator of claim 1, wherein:

an interior surface of the cabinet comprises a back surface and a pair of side surfaces; and the pair of side surfaces comprise a reflective material.

7. The refrigerator of claim 1, wherein an interior surface of the door comprises a three-dimensional molded surface.

8. The refrigerator of claim 1, further comprising:

a storage structure within the compartment area, wherein the wall panel is disposed between the storage structure and the cabinet.

9. The refrigerator of claim 8, wherein the storage structure is one of a shelf and a drawer.

10. The refrigerator of claim 1, wherein the wall panel is formed of a translucent material.

11. An appliance comprising:

a cabinet having a back wall, a top wall, a bottom wall, and a pair of side walls;

a compartment area for storing food within the cabinet;

a door configured to seal the compartment area;

a storage structure disposed within the compartment area; and a wall panel, wherein the wall panel is co-extensive with the back wall of the cabinet and extends a full height and width of the back wall of the cabinet, and further wherein the wall panel includes a three-dimensional molded surface.

12. The appliance of claim 11, wherein the three-dimensional molded surface includes irregular alternating peaks and valleys.

13. The appliance of claim 12, wherein the three-dimensional molded surface comprises a three-dimensional pattern extending from a first side end of the wall panel to a second side end of the wall panel.

14. The appliance of claim 11, wherein the wall panel further comprises a lighting structure.

15. The appliance of claim 14, further comprising:

control circuitry configured to activate the lighting structure based on user interaction with said appliance.

16. An appliance comprising:

a cabinet defining a compartment area for storing food within the cabinet;

a door operably coupled with the cabinet; and a wall panel disposed within the cabinet, wherein the wall panel is co-extensive with a back wall of the cabinet and extends a full height and width of the back wall of the cabinet, and further wherein the wall panel includes a three-dimensional molded surface having irregular alternating peaks and valleys extending from a first side end of the wall panel to a second side end of the wall panel.

17. The appliance of claim 16, wherein the wall panel further comprises a lighting structure that back lights the wall panel.

18. The appliance of claim 17, further comprising:

control circuitry configured to activate the lighting structure based on user interaction with said appliance.

19. The appliance of claim 16, wherein the wall panel is formed of a material that is at least partially translucent.

* * * * *